US008441505B2

(12) United States Patent
Chen

(10) Patent No.: US 8,441,505 B2
(45) Date of Patent: May 14, 2013

(54) SYSTEM AND METHOD OF DRIVING A LIQUID CRYSTAL DISPLAY

(75) Inventor: Ying Lieh Chen, Tainan (TW)

(73) Assignee: Himax Technologies Limited, Tainan (TW)

( * ) Notice: Subject to any disclaimer, the term of this patent is extended or adjusted under 35 U.S.C. 154(b) by 690 days.

(21) Appl. No.: 12/631,041

(22) Filed: Dec. 4, 2009

(65) Prior Publication Data

US 2011/0134093 A1 Jun. 9, 2011

(51) Int. Cl.
*G09G 5/10* (2006.01)

(52) U.S. Cl.
USPC ..... 345/690; 345/211; 345/204; 345/98; 345/87; 345/52; 345/50

(58) Field of Classification Search ..... None
See application file for complete search history.

(56) References Cited

U.S. PATENT DOCUMENTS

2009/0079767 A1* 3/2009 Morita ..... 345/690
2009/0109153 A1* 4/2009 Nii ..... 345/87
2009/0295614 A1* 12/2009 Avon et al. ..... 341/155

* cited by examiner

*Primary Examiner* — Joseph Haley
*Assistant Examiner* — Ifedayo Iluyomade
(74) *Attorney, Agent, or Firm* — Baker & McKenzie LLP

(57) ABSTRACT

A driver unit comprises a latch circuit for holding digital image data in a voltage state, a digital-to-analog converter, and a voltage compensator circuit for raising the analog display voltage. The digital-to-analog converter can access content of the digital image data from the voltage state in the latch circuit, and convert the digital image data into analog display signals. In other embodiments, a method of driving a liquid crystal display comprises storing digital image data in a latch circuit under a voltage state, accessing a content of the digital image data from the voltage state held in the latch circuit, selecting a reference voltage according to the content of the digital image data for converting the digital image data into analog display signals, and raising the analog display voltage for obtaining a driving voltage.

17 Claims, 12 Drawing Sheets

SYSTEM AND METHOD OF DRIVING A LIQUID CRYSTAL DISPLAY

FIELD OF THE INVENTION

The present invention relates to systems and methods for driving a liquid crystal display.

BACKGROUND

A conventional liquid crystal display (LCD) device includes a display panel coupled with a driver unit. A typical architecture for the driver unit comprises a timing controller, a scan driver, and a data driver. The timing controller usually receives digital image data from a host device, generates control signals for the scan driver and data driver, and transmits the digital image data to the data driver. The scan driver, coupled with pixels in horizontal directions, is used to sequentially select rows of pixels, whereas the data driver coupled with pixel in vertical directions is operable to convert digital image data into driving voltages for controlling the state of pixels in the display panel.

FIG. 1 is a simplified diagram illustrating a conventional data driver 10. The data driver 10 comprises a latch circuit 11, a level shifter 13, a digital-to-analog converter (DAC) 15, and a buffer circuit 17. The latch circuit 11 holds digital image data provided by a timing controller (not shown). The level shifter 13 is used for converting the voltage state of the digital image data held in the latch circuit 11 into a high voltage state. The DAC 15 can be driven by the high voltage stage image data provided by the level shifter 13, and accordingly select a reference voltage among a plurality of reference voltages provided by a gamma voltage generator 19 for converting the digital image data into analog display signals. The analog display signals may be buffered in the buffer circuit 17, and outputted via the corresponding data line.

Unfortunately, the above conventional architecture may have certain drawbacks. For example, the circuit layout of the DAC 15, which operates in a high-voltage range, requires larger size transistors and wide wiring lines for preventing transistor breakdown or current leakage. As a result, the size of the circuit layout is adversely increased.

Therefore, there is presently a need for a system and method that can drive a liquid crystal display panel in a more cost-effective manner, and address at least the foregoing issues.

SUMMARY

The present application describes a system and method of driving a liquid crystal display panel. In some embodiments, a driver unit for a display panel is described. The driver unit comprises a latch circuit for holding digital image data in a voltage state, a digital-to-analog converter, and a voltage compensator circuit for raising the analog display voltage. More specifically, the digital-to-analog converter is configured to access the voltage state held in the latch circuit for reading a content of the digital image data, and to convert the digital image data into an analog display voltage by referring to a reference voltage selected according to the content of the digital image data.

In addition, the present application also describes methods of driving a liquid crystal display device. In some embodiments, the method comprises storing digital image data in a latch circuit under a voltage state, accessing a content of the digital image data from the voltage state held in the latch circuit, selecting a reference voltage according to the content of the digital image data for converting the digital image data into an analog display voltage, and raising the analog display voltage for obtaining a driving voltage.

In another embodiment, the method for driving the liquid crystal display comprises providing a plurality of reference voltages from a gamma voltage generator, lowering the provided reference voltages for obtaining a plurality of adjusted reference voltages, and selecting one of the adjusted reference voltages according to a content of digital image data for converting the digital image data into an analog display voltage.

At least one advantage of the systems and methods described herein is the ability to use a low voltage digital-to-analog converter in the data driver. Because electric elements constituting the low voltage digital-to-analog converter (such as transistors, wiring lines, etc.) can be formed with reduced sizes, the dimensions and circuit layout of the digital-to-analog converter can be simplified and reduced.

The foregoing is a summary and shall not be construed as limiting the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENTS

Figure 1:
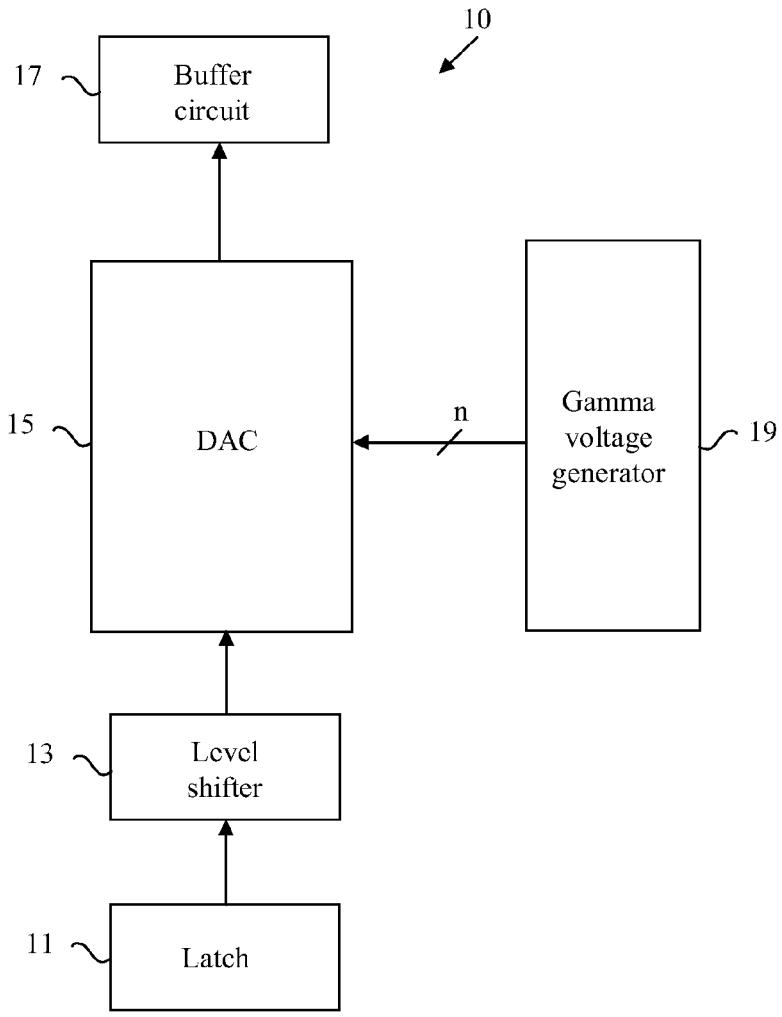
FIG.1 (Prior Art)
FIG. 1 is a simplified diagram illustrating a conventional data driver.
Figure 2:
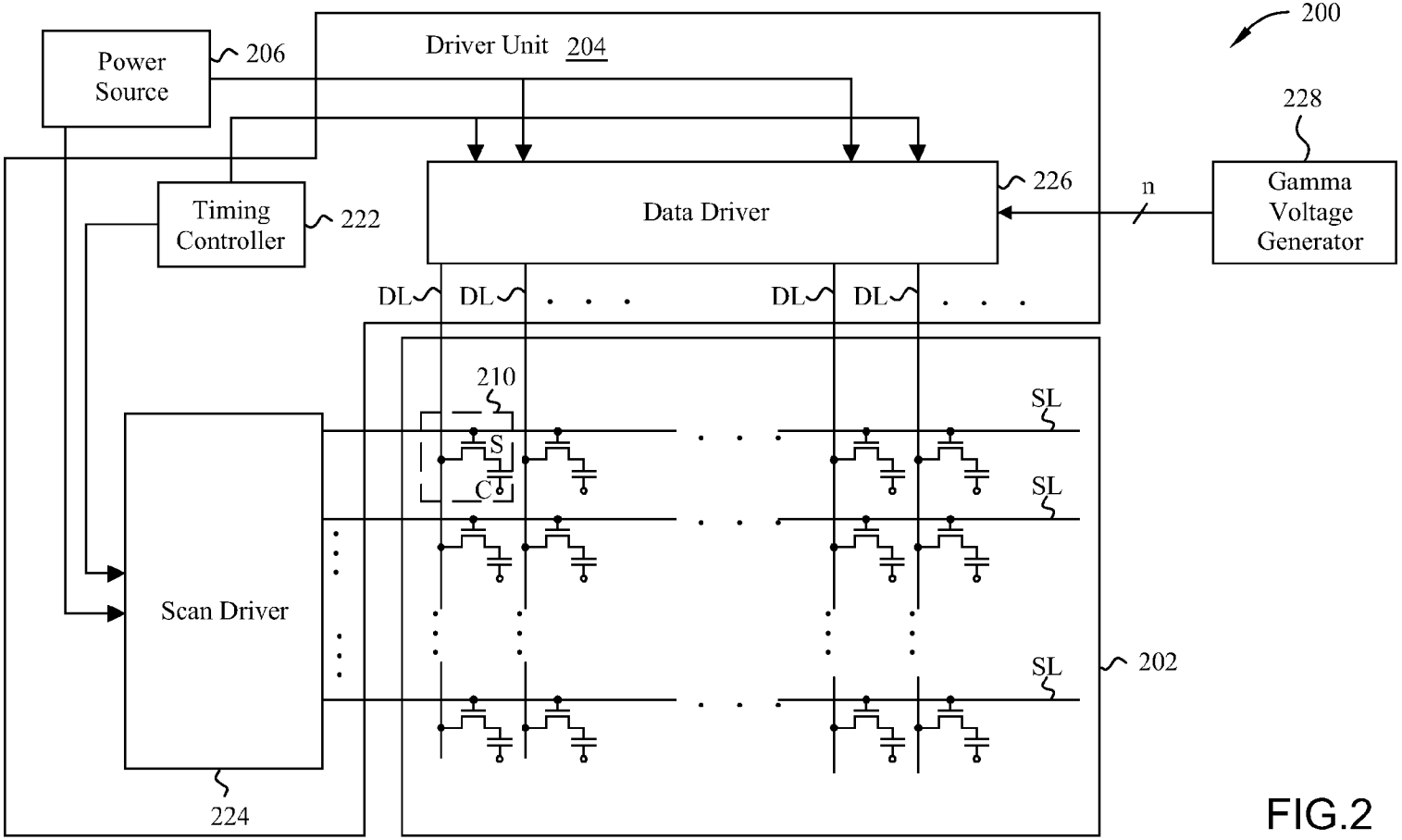
FIG. 2 is a schematic diagram of a liquid crystal display device according to one embodiment of the present invention.

FIG. 2 is a schematic diagram of a liquid crystal display device 200 according to one embodiment of the present invention. The liquid crystal display 200 includes a display panel 202, a driver unit 204, and a power source 206. The display panel 202 may be a reflective type, transmissive type, or transflective type liquid crystal display panel. The display panel 202 comprises an array of pixels 210 operable under control of the driver unit 204 for displaying an image. Each pixel 210 of the display panel 202 may include a switching element S, such as a thin-film transistor (TFT), which is coupled with a storage capacitor C and a pixel electrode (not shown). The driver unit 204, powered by the power source 206, includes a timing controller 222, a scan driver 224 (also commonly called "gate driver" or "gate line driver"), and a data driver 226 (also commonly called "source driver" or "source line driver"). The timing controller 222 receives digital image data from a host device (not shown), generates control signals for the scan driver 224 and data driver 226, and transmits the digital image data to the data driver 226. The host device may include a computer graphics card, a computer central processing unit (CPU), a television adapter, or like display data sources. The scan driver 224 is coupled with horizontal rows of pixels 210 through multiple scanning lines SL, whereas the data driver 226 is coupled with vertical columns of pixels 210 through multiple data lines DL. The scan driver 224 and data driver 226 may be built from an integrated circuit (IC) chip that is mounted on the display panel 202 according to various methods, such as tape carrier packages (TCP), chip-on-glass (COG) technology, or the like. In alternate embodiments, either of the scan or data drivers may also be integrated into a single IC chip.

During a horizontal synchronizing period, the scan driver 224 turns on the TFTs coupled along one selected scanning line SL, whereas the data driver 226 converts the digital image data provided by the host device into driving signals using reference voltages provided by a gamma voltage generator 228, and applies the driving signals through the data lines DL onto the turned-on TFTs to charge the associated capacitors C with display voltages corresponding to gray scale levels. Owing to a voltage difference between a common electrode (not shown) and the display electrodes applied with the display voltages latched by the storage capacitors C, liquid crystal molecules (not shown) in the display panel 202 are controllably oriented to achieve a desired light transmittance. Each horizontal row of pixels 210 can be sequentially driven in the same manner for displaying a complete image frame.

Figure 3:
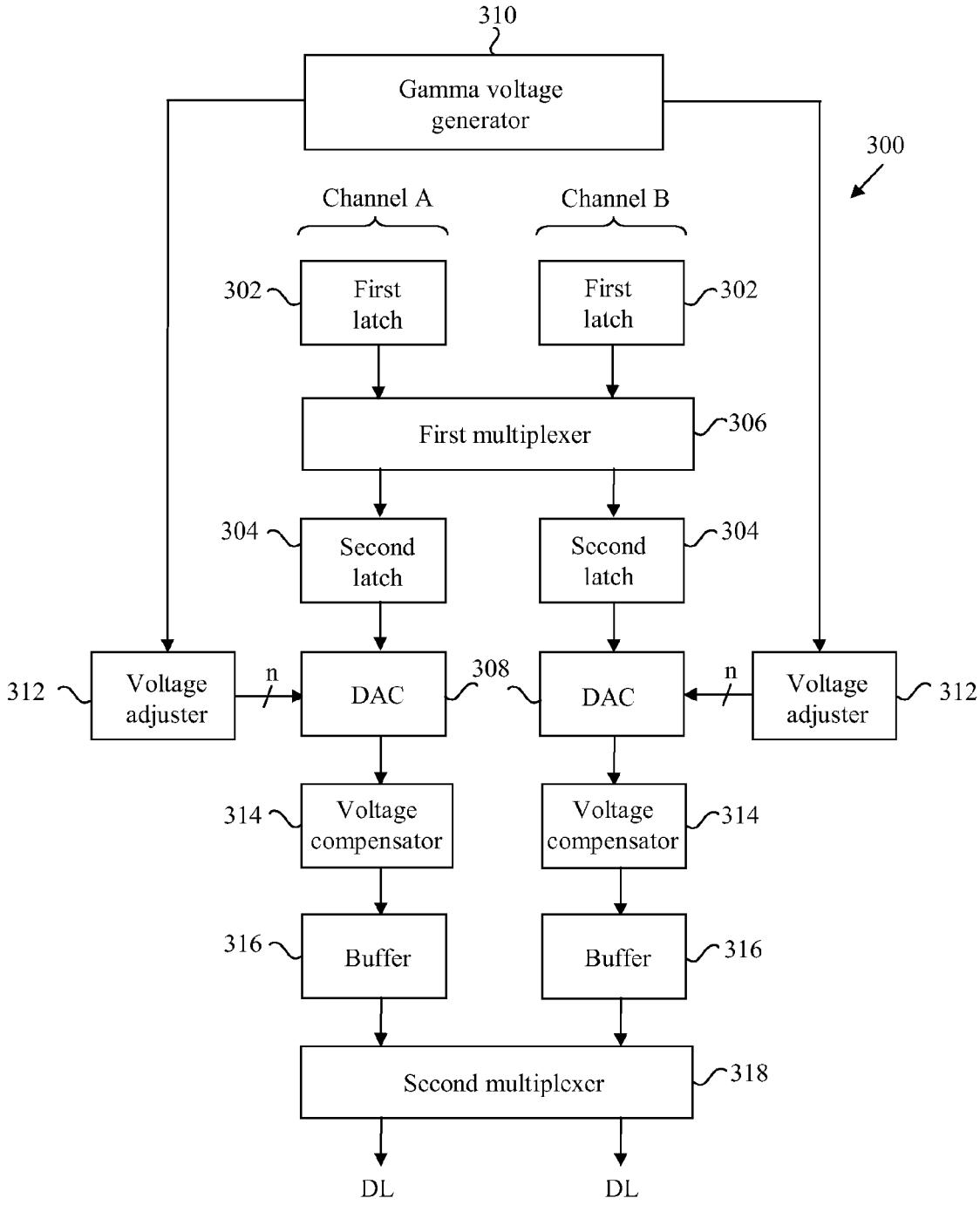
FIG. 3 is a block diagram illustrating a data driver according to an embodiment of the present invention.

FIG. 3 is a block diagram illustrating a data driver 300 according to an embodiment of the present invention. The data driver 300 may be used in a liquid crystal display device such as the one illustrated in FIG. 2. The data driver 300 may include two channels A and B for respectively processing display signals of two opposite polarities, i.e., positive and negative polarities. Each of the two channels A and B comprises a first latch circuit 302 connected with a second latch circuit 304 via a first multiplexer 306, a digital-to-analog converter (DAC) 308 coupled with a gamma voltage generator 310 via a voltage adjuster circuit 312, a voltage compensator circuit 314, a buffer circuit 316, and a second multiplexer circuit 318.

In each of the two channels A and B, the first latch circuit 302 sequentially samples digital image data transmitted from a timing controller in synchronization with sampling pulses, and holds the digital image data during one horizontal sampling period. The digital image data may include color values that are defined in any color system, e.g., the red (R), green (G) and blue (B) color system. In synchronization with a latch signal, the second latch circuit 304 receives and latches in one time all the digital image data sampled from the first latch circuit 302 via the first multiplexer 306. The digital image data are then converted by the DAC 308 into analog display signals.

The DAC 308 can be a low-voltage DAC 308 that operates in a low-voltage range. One advantage of the low-voltage DAC 308 is the ability to simplify and reduce the dimensions of its circuit layout, because electric elements constituting the low-voltage DAC 308 (such as transistors, wiring lines, etc.) can be formed with reduced sizes. Another advantage of the low voltage DAC 308 is the ability to reduce RC delay, thus allowing higher operation speed, and lower reference voltage distortion. Moreover, because the digital image data are stored in the second latch circuit 304 in a low voltage state, the low-voltage DAC 308 can read the content of the digital image data directly from the voltage state held in the second latch circuit 304, without the need of an intermediate level shifter circuit.

In one embodiment, the gamma voltage generator 310 may output a plurality of reference voltages that are adapted for a DAC operating in a high-voltage range. To adapt these reference voltages to levels suitable for use by the low voltage DAC 308, the voltage adjuster circuit 312 can be provided for lowering the reference voltages issued by the gamma voltage generator 310 from high voltage levels to low voltage levels.

Referring again to FIG. 3, the DAC 308 can read the content of the digital image data from the low voltage state held in the second latch circuit 304, select one of a plurality of reference voltages adjusted via the voltage adjuster circuit 312, and convert the digital image data into an analog display voltage in a low voltage range by reference to the selected reference voltage. The voltage compensator circuit 314, which is connected downstream of the DAC 308, can raise the analog display voltage issued from the DAC 308 to a high voltage level, and output a resulting driving voltage in a high voltage state to the buffer circuit 316. The buffer circuit 316 can be a unit gain amplifier. The buffer circuit 316 can buffer the driving voltage outputted from the voltage compensator circuit 314, quickly charge or discharge the data line DL of a LCD panel, and draw its voltage level to a desired value. In some embodiment, the buffer circuit 316 can also selectively pass the driving voltage outputted from the voltage compensator circuit 314 through the second multiplexer 318 for saving power consumption.

Figure 3A:
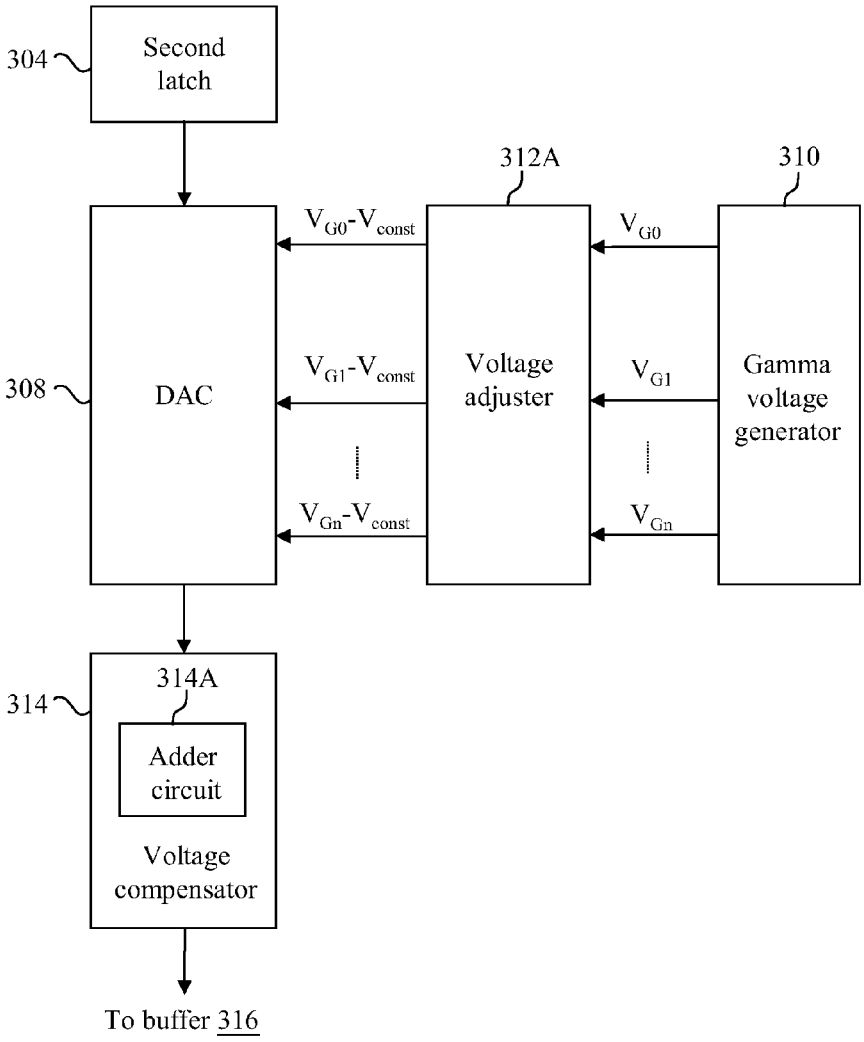
FIG. 3A is a simplified diagram illustrating an implementation of voltage adjuster and voltage compensator circuits in a data driver according to one embodiment of the present invention.

Depending on the adjustment method applied by the voltage adjuster circuit 312, various embodiments may be implemented for the voltage compensator circuit 314. FIG. 3A is a schematic diagram illustrating one exemplary embodiment in which the voltage adjuster circuit 312A can adjust reference voltages $V_{G0}$ to $V_{Gn}$ issued by the gamma voltage generator 310 by subtracting a same constant amount of voltage $V_{const}$ from each of the reference voltages $V_{G0}$ to $V_{Gn}$. In this case, the voltage compensator circuit 314 can include an adder circuit 314A that can add a compensation voltage approximately equal to $V_{const}$ to the analog display voltage outputted from the DAC 308, and output a resulting driving voltage in a high voltage state to the buffer circuit 316.

Figure 3B:
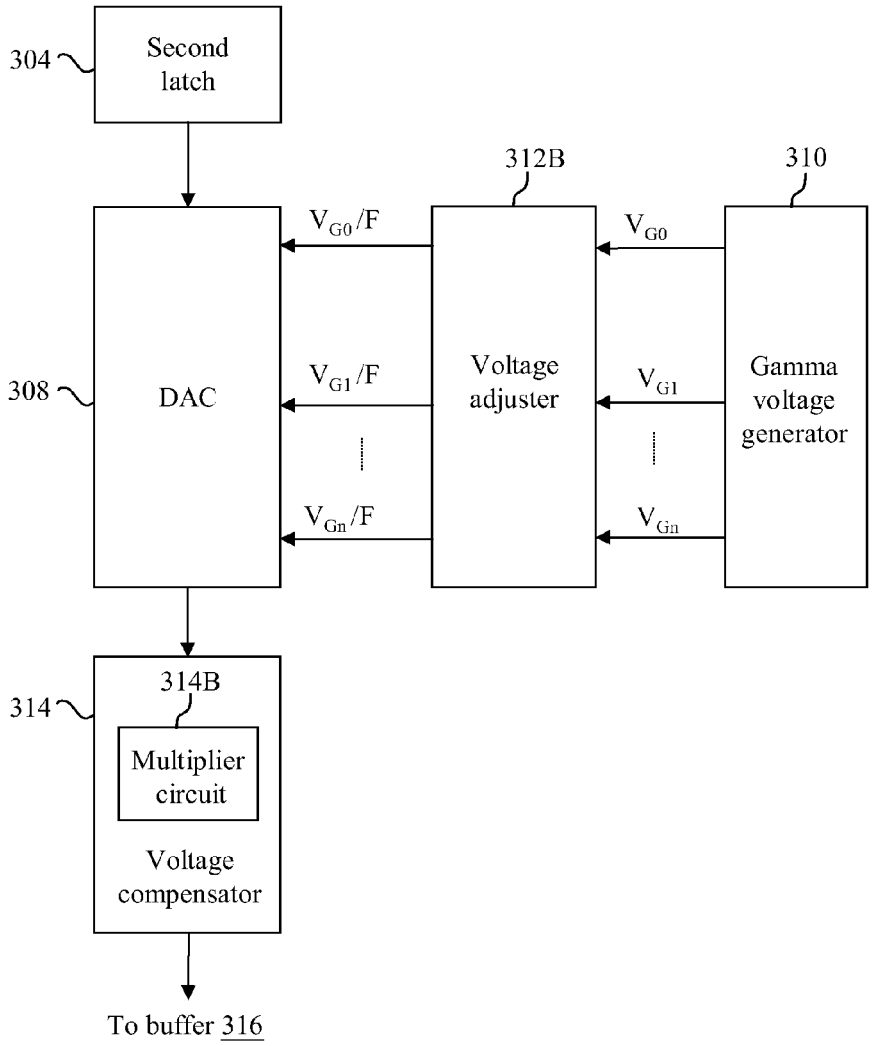
FIG. 3B is a simplified diagram illustrating another implementation of voltage adjuster and voltage compensator circuits in a data driver according to one embodiment of the present invention.

FIG. 3B is a schematic diagram illustrating a variant embodiment in which the voltage adjuster circuit 312B may adjust reference voltages $V_{G0}$ to $V_{Gn}$ issued by the gamma voltage generator 310 by dividing each of the reference voltages $V_{G0}$ to $V_{Gn}$ by a same factor F. In this case, the voltage compensator circuit 314 can include a multiplier circuit 314B that can multiply the analog display voltage from the DAC 308 with a compensation factor equal to F, and then output a resulting driving voltage in a high voltage state to the buffer circuit 316.

It is worth noting that the aforementioned reference voltages $V_{G0}$ to $V_{Gn}$ may be either positive or negative voltages depending on whether the processed display signal is of positive or negative polarity (i.e., channel A or B shown in FIG. 2). Accordingly, the adjustment and compensation described above can be applied similarly for positive and negative polarity display signals.

Figure 4:
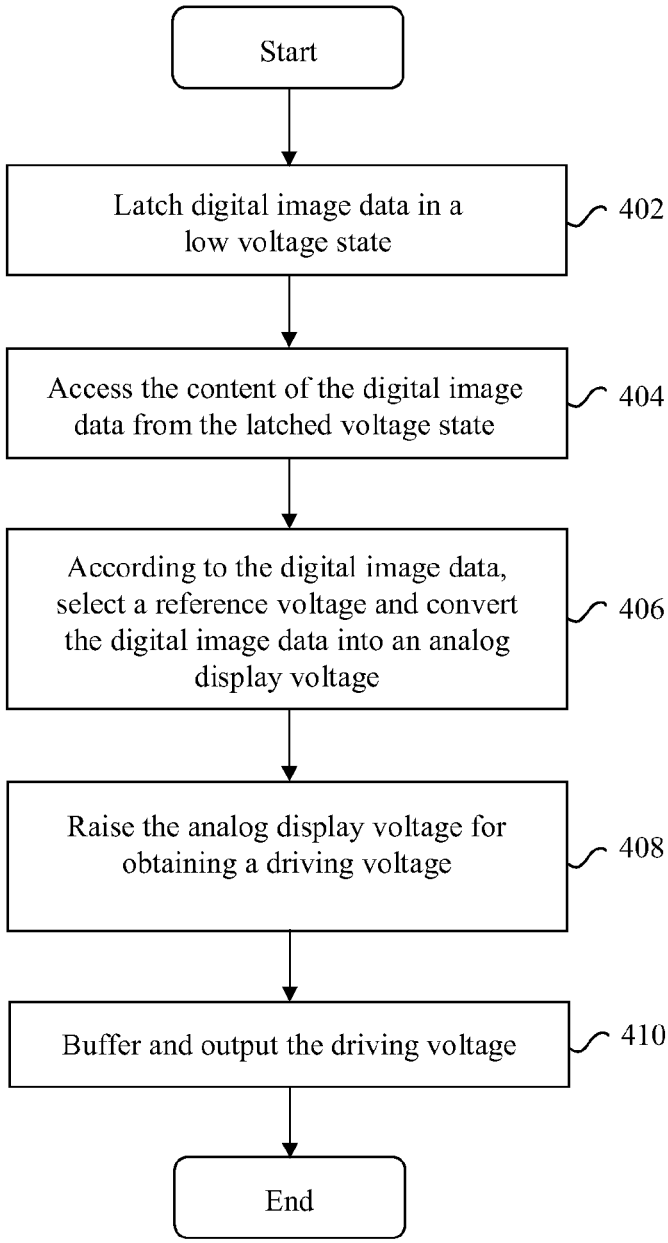
FIG. 4 is a flowchart of method steps performed in a data driver according to an embodiment of the present invention.

FIG. 4 is a flowchart of method steps performed by the data driver 300 according to one embodiment of the present invention. In initial step 402, the digital image data are received and latched via the first and second latch circuits 302 and 304 in a low voltage state. In step 404, the DAC 308 can access the content of the digital image data from the voltage state held in the second latch circuit 304. According to the content of the digital image data, the DAC 308 in next step 406 selects a reference voltage among a plurality of provided reference voltages, and then converts the digital image data into an analog display voltage by reference to the selected reference voltage. As described previously, the provided reference voltages can be adjusted reference voltages provided via the voltage adjuster circuit 312. These adjusted reference voltages can be obtained by either subtracting an amount of voltage $V_{const}$ from each of the reference voltages issued from the gamma voltage generator 310, or dividing each of the reference voltages by a given factor F. In following step 408, the voltage compensator circuit 314 can then raise the analog display voltage outputted from the DAC 308 to a higher voltage level for obtaining a driving voltage. More particularly, in case the adjusted reference voltages are obtained by subtracting an amount of voltage $V_{const}$ from each of the reference voltages, the voltage compensator circuit 314 can raise the analog display signal outputted from the DAC 308 by adding the voltage $V_{const}$ to the analog display signal. On the other hand, if the adjusted reference voltages are obtained by dividing each of the reference voltages by a given factor F, the voltage compensator circuit 314 can raise the analog display signal outputted from the DAC 308 by multiplying the analog display signal by the factor F. Eventually, in step 410, the driving voltage from the voltage compensator circuit 314 is processed through the buffer circuit 316 and outputted via the second multiplexer 318 to a data line DL.

Because the DAC 308 implemented in the aforementioned embodiment works in a low-voltage range, the circuit layout of the DAC 308 can be simplified and have smaller dimensions. In addition, the operation voltage difference of the low voltage DAC 308 can be substantially reduced compared to a conventional high voltage DAC circuit. While the voltage adjuster circuits described in the aforementioned embodiments apply fixed adjustment methods (i.e., subtracting with a same constant voltage $V_{const}$, or dividing by a same constant factor F), variable voltage adjustment methods can also be possible as described below.

Figure 5A:
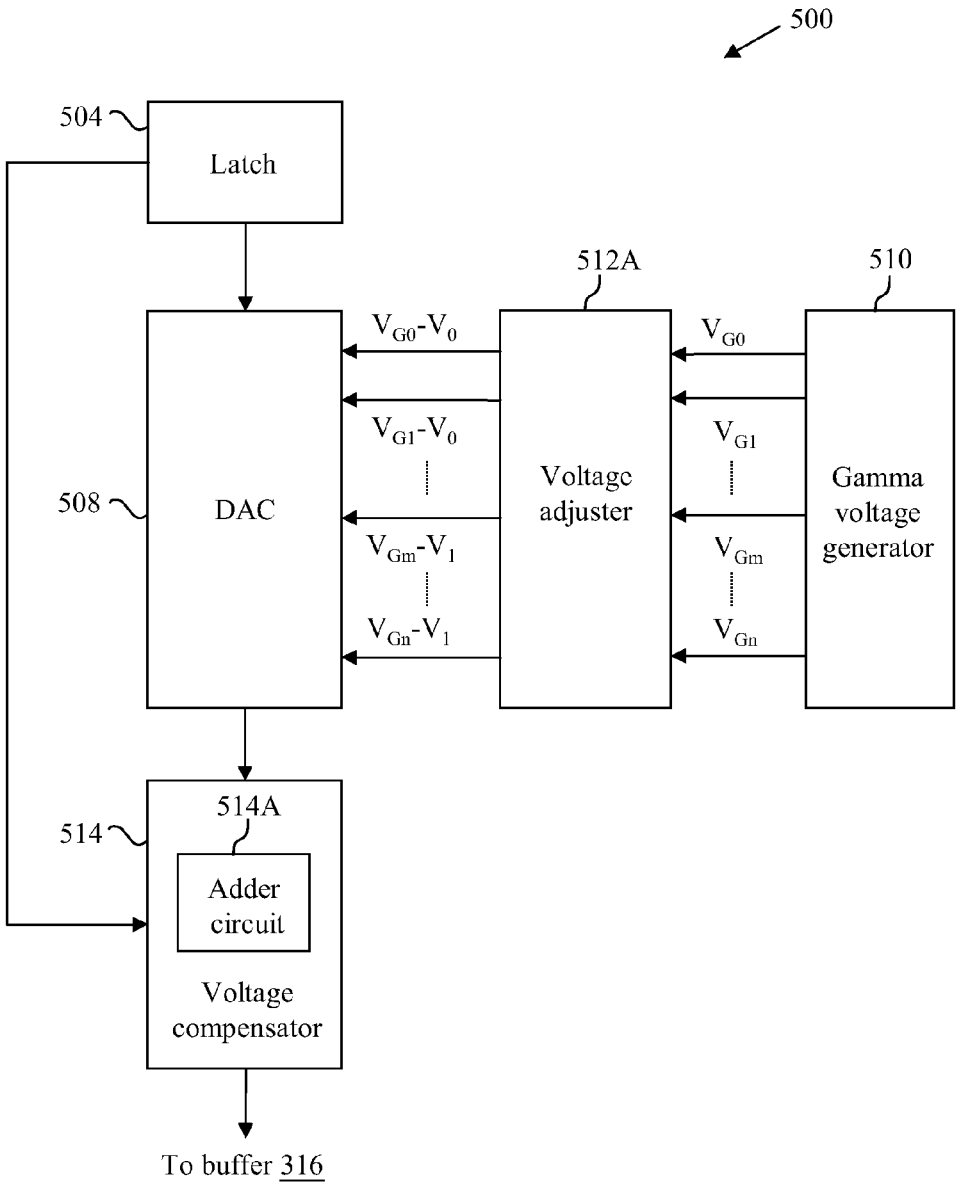
FIG. 5A is a simplified diagram illustrating other embodiments of voltage adjuster and voltage compensator circuits in a data driver.

FIG. 5A is a simplified block diagram illustrating an embodiment of a data driver 500 using a DAC 508 operating in a low-voltage range. Like the previous embodiment, the DAC 508 can access digital image data stored in the latch circuit 504 (equivalent to the second latch circuit 304 shown in FIG. 3) in a low voltage state, select a reference voltage provided from a voltage adjuster circuit 512A, convert the digital image data into an analog display voltage by reference to the selected reference voltage, and output the analog display voltage to a voltage compensator circuit 514. However, the voltage adjuster circuit 512A of the present embodiment can apply a variable voltage adjustment to the reference voltages provided by the gamma voltage generator 510. For example, suppose that the gamma voltage generator 510 provides a plurality of orderly increasing reference voltages $V_{G0}$, $V_{G1}$, $V_{Gm}$ and $V_{Gn}$, wherein $V_{G0}$ is the smallest reference voltage, $V_{Gn}$ is the highest reference voltage, and $V_{Gm}$ is an intermediate reference voltage between $V_{G0}$ and $V_{Gn}$. The voltage adjuster circuit 512A can adjust the reference voltages by subtracting a first voltage level $V_0$ from each reference voltage that is smaller than $V_{Gm}$, and by subtracting a second voltage level $V_1$ from each reference voltage that is equal to or greater than $V_{Gm}$. In one embodiment, the intermediate reference voltage $V_{Gm}$ may be a median reference voltage, the range of reference voltages from $V_{Gm}$ to $V_{Gn}$ being associated with digital image data having a most superior bit equal to the binary value 1, while the range of reference voltages strictly less than $V_{Gm}$ and greater than or equal to $V_{G0}$ is associated with digital image data having a most superior bit equal to the binary value 0. Moreover, the absolute value of the second voltage level $V_1$ can be greater than that of the first voltage level $V_0$. In this manner, the reference voltages provided by the gamma voltage generator 510 can be adjusted differently in the lower ($V_{G0}$, $V_{Gm}$) and upper range ($V_{Gm}$, $V_{Gn}$) of values.

According to the content of the digital image data read from the latch 504, the DAC 508 can select an adjusted reference voltage provided by the voltage adjuster circuit 512A, and use the selected reference voltage to convert the digital image data into an analog display voltage. The analog display voltage can be then processed through the voltage compensator circuit 514 that raises the analog display voltage for obtaining a driving voltage in a high voltage state.

As shown in FIG. 5A, the voltage compensator circuit 514 includes an adder circuit 514A that can be configured to add a compensation voltage substantially equal to the voltage adjustment applied by the voltage adjuster circuit 512. Accordingly, the voltage compensator circuit 514 may need to access the digital image data from the latch circuit 504 to determine the amount of voltage adjustment applied by the voltage adjuster circuit 512A. For example, in case the digital image data has a most superior bit equal to 1, the adder circuit 514A can add a compensation voltage that is substantially equal to the corresponding voltage adjustment $V_1$ applied by the voltage adjuster circuit 512A. In contrast, if the digital image data has a most superior bit equal to 0, the adder circuit 514A can add a compensation voltage that is substantially equal to the corresponding voltage adjustment $V_0$ applied by the voltage adjuster circuit 512A. The driving voltage generated by adding the compensation voltage to the analog display voltage may then be processed through the buffer circuit 316 in a manner similar to the embodiments previously described.

Figure 5B:
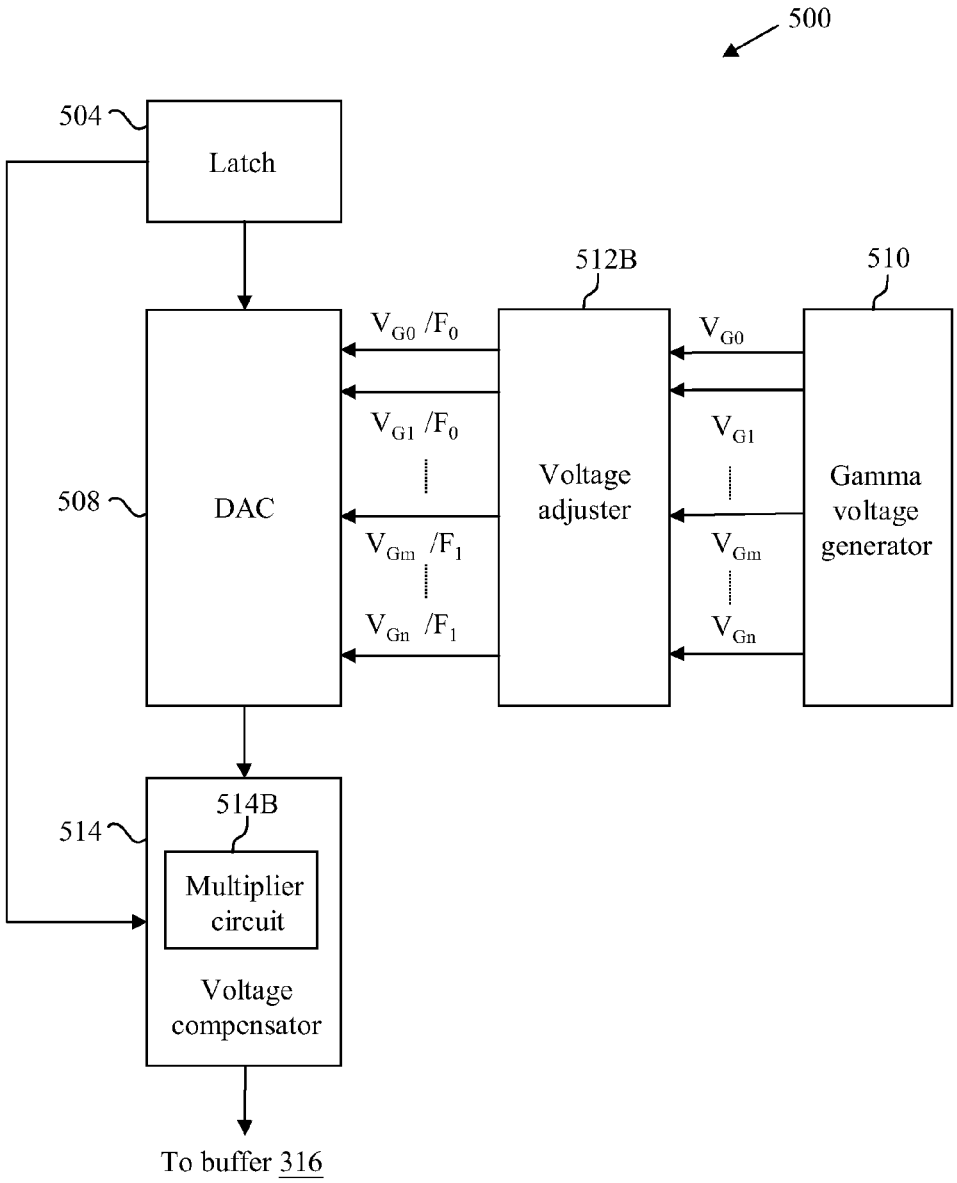
FIG. 5B is a simplified diagram illustrating other variant embodiments of voltage adjuster and voltage compensator circuits in a data driver.

While the voltage adjuster circuit 512A shown in FIG. 5A applies an adjustment method that subtracts an amount of voltage from each reference voltage issued from the gamma voltage generator 510, alternate embodiments can also apply an adjustment method that divides each reference voltage by a predetermined factor, as shown in FIG. 5B. Rather than applying a subtraction operation as shown in FIG. 5A, the voltage adjuster circuit 512B shown in FIG. 5B applies a division operation in which each reference voltage that is smaller than $V_{Gm}$ is divided by a first factor $F_0$, and each reference voltage that is equal to or greater than $V_{Gm}$ is divided by a second factor $F_1$. Correspondingly, the voltage compensator circuit 514 is modified to include a multiplier circuit 514B that can raise the analog display voltage outputted from the DAC 508 by multiplying the analog display voltage by the factor $F_0$ or $F_1$, in accordance with the adjustment applied by the voltage adjuster circuit 512B. The driving voltage obtained by multiplying the analog display voltage with the compensation factor (i.e., $F_0$ or $F_1$) may be then processed through the buffer circuit 316 in a manner similar to the embodiments previously described.

Figure 6A:
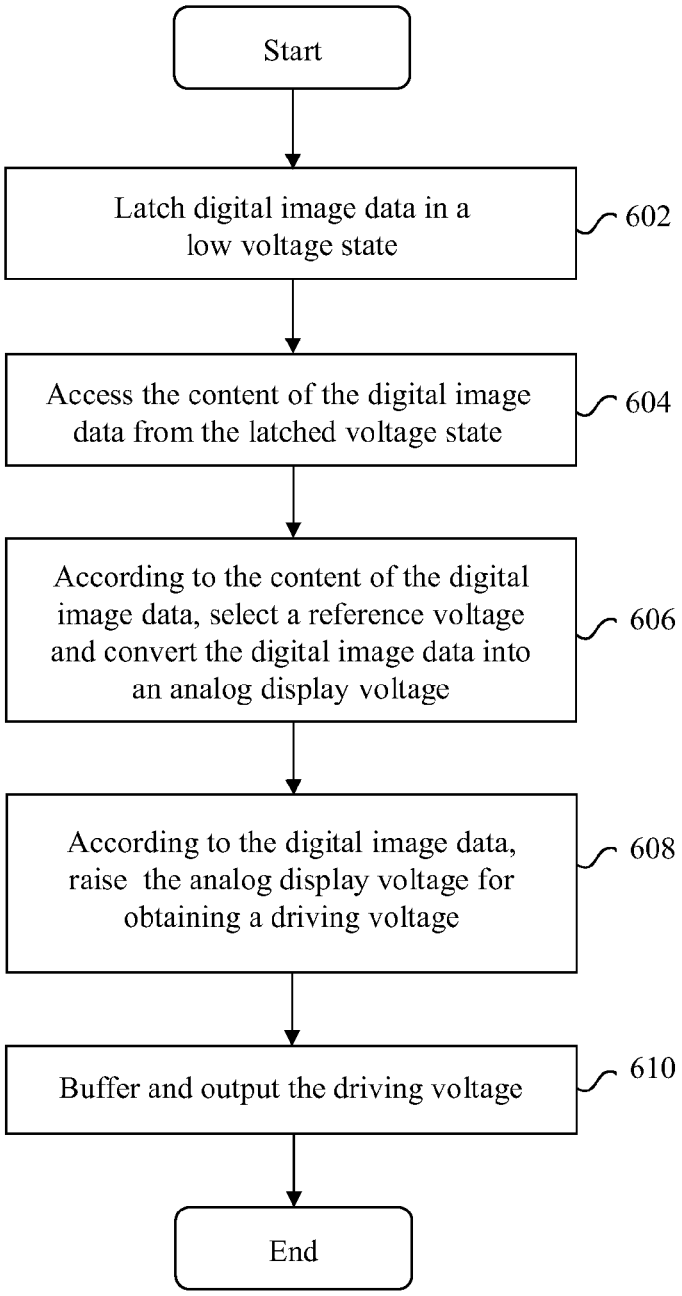
FIG. 6A is a flowchart of method steps performed by a data driver according to an embodiment of the present invention.

FIG. 6A is a flowchart of method steps performed by the data driver 500 according to an embodiment of the present invention. In initial step 602, the digital image data is latched in the latch circuit 504 in a low voltage state. In step 604, the DAC 508 can access the content of the digital image data from the voltage state held in the latch circuit 504. According to the content of the digital image data, the DAC 508 in next step 606 selects a reference voltage among a plurality of provided reference voltages, and then converts the digital image data into an analog display voltage by reference to the selected reference voltage. As described previously, the provided reference voltages may include adjusted reference voltages obtained through the voltage adjuster circuit 512A by applying a subtraction operation (as shown in FIG. 5A), or through the voltage adjuster circuit 512B by applying a division operation (as shown in FIG. 5B).

In step 608, according to the content of the digital image data held in the latch circuit 504, the voltage compensator circuit 514 can then proceed to raise the analog display voltage for obtaining a driving voltage. Eventually, in step 610, the driving voltage can be processed through the buffer circuit 316 and outputted via the second multiplexer 318 to a data line.

Figure 6B:
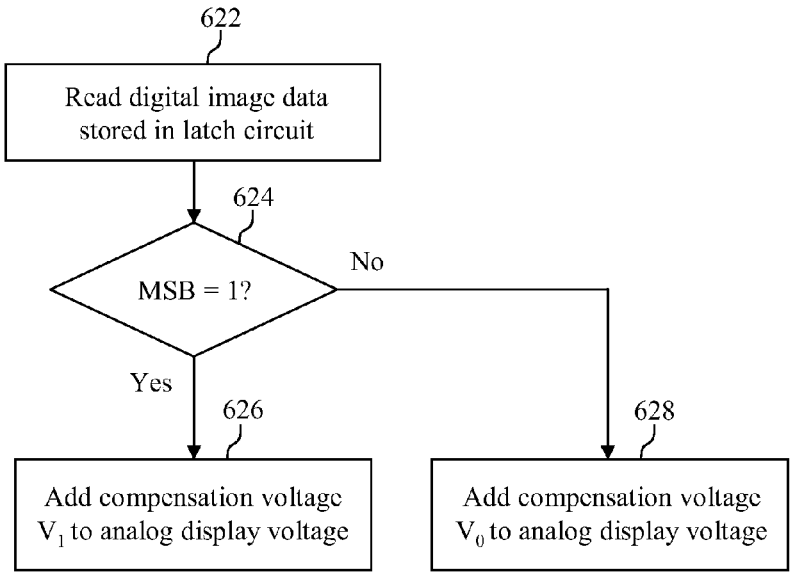
FIG. 6B is a flowchart illustrating method steps for raising an analog display voltage in a data driver as shown in FIG. 5A.

In conjunction with the embodiment shown in FIG. 5A, FIG. 6B is a flowchart illustrating sub-steps performed by the voltage compensator circuit 514 for raising the analog display voltage when the applied voltage adjustment method subtracts an amount of voltage from each reference voltage issued from the gamma voltage generator 510. In step 622, the voltage compensator circuit 514 can read the content of the digital image data from the latch circuit 504 for determining the amount of voltage adjustment applied by the voltage adjuster circuit 512A. For example, in step 624, the voltage compensator circuit 514 can determine whether the most superior bit (MSB) of the digital image data is equal to 1. In case the most superior bit (MSB) of the digital image data equals 1, the adder circuit 514A of the voltage compensator circuit 514 in following step 626 can add the compensation voltage $V_1$ to the analog display voltage outputted from the DAC 508 for obtaining the driving voltage.

In contrast, when the most superior bit (MSB) of the digital image data equals 0, the adder circuit 514A of the voltage compensator circuit 514 in step 628 can add the compensation voltage $V_0$ to the analog display voltage outputted from the DAC 508 for obtaining the driving voltage.

Figure 6C:
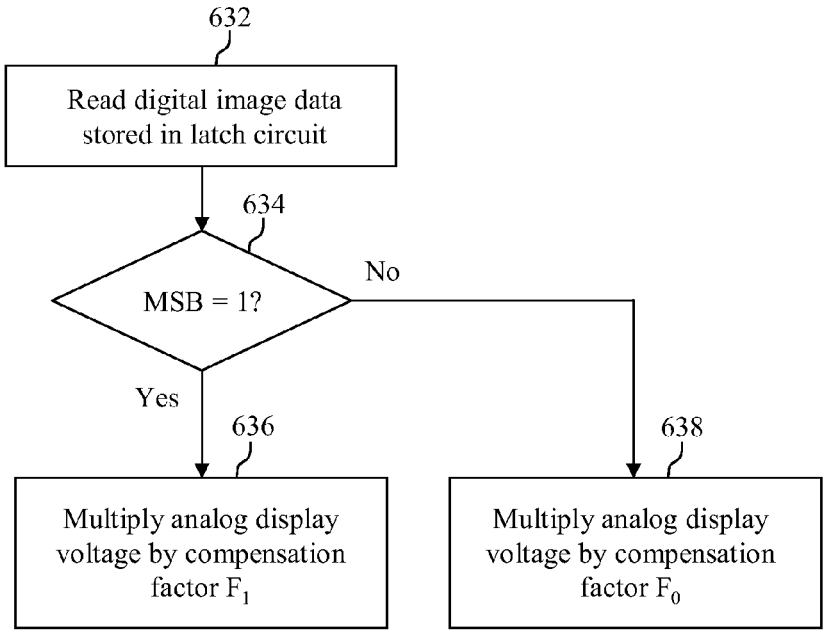
FIG. 6C is a flowchart illustrating method steps for raising an analog display voltage in a data driver as shown in FIG. 5B.

In conjunction with the embodiment shown in FIG. 5B, FIG. 6C is a flowchart further illustrating sub-steps performed by the voltage compensator circuit 514 for raising the analog display voltage when the applied voltage adjustment method divides each reference voltage issued from the gamma voltage generator 510 by a given factor. In step 632, the voltage compensator circuit 514 can read the content of the digital image data from the latch circuit 504 for determining the amount of voltage adjustment applied by the voltage adjuster circuit 512B. For example, in step 634, the voltage compensator circuit 514 can determine whether the most superior bit (MSB) of the digital image data is equal to 1. In case the most superior bit (MSB) of the digital image data equals 1, the multiplier circuit 514B of the voltage compensator circuit 514 can perform step 636, whereby the analog display voltage outputted from the DAC 508 is multiplied by the compensation factor $F_1$ for obtaining the driving voltage.

When the most superior bit (MSB) of the digital image data equals 0, the multiplier circuit 514B of the voltage compensator circuit 514 can perform step 638, whereby the analog display voltage outputted from the DAC 508 is multiplied by the compensation factor $F_0$ for obtaining the driving voltage.

Figure 7:
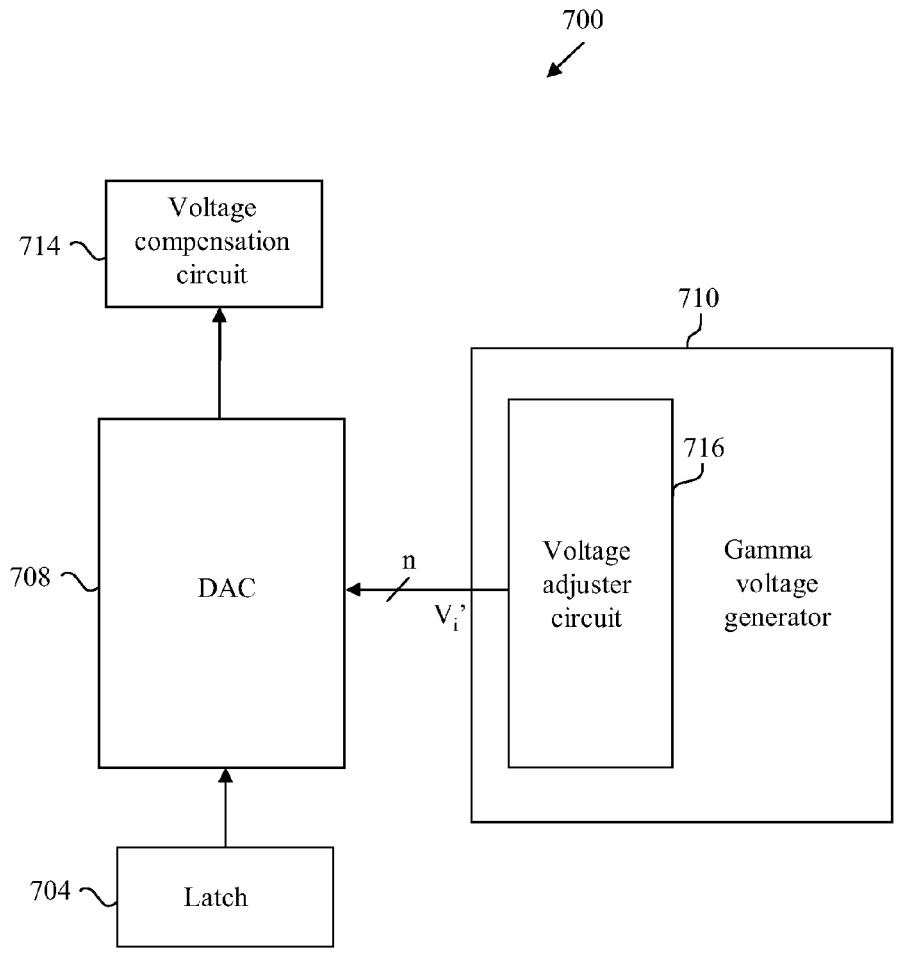
FIG. 7 is a simplified block diagram of a data driver according to another variant embodiment.

While the foregoing embodiments provide a separate voltage adjuster circuit for adapting the outputs of the gamma voltage generator, alternate embodiments may also design a gamma voltage generator that integrates the voltage adjuster circuit therein. FIG. 7 is a simplified block diagram of another data driver 700 illustrating such embodiment. The data driver 700 includes a latch circuit 704, a DAC 708 operating in the low voltage range, a gamma voltage generator 710, and an voltage compensator circuit 714. The data driver 700 differs from the previous embodiments in the configuration of the gamma voltage generator 710, which includes a voltage adjuster circuit 716 therein. The gamma voltage generator 710 can thus output adjusted reference voltages $V_i'$ that are compatible with the low-voltage operating DAC 708.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A method of driving a liquid crystal display panel, comprising:

storing digital image data in a latch circuit under a voltage state;

accessing a content of the digital image data from the voltage state held in the latch circuit;

according to the content of the digital image data, selecting a reference voltage for converting the digital image data to an analog display voltage; and raising the analog display voltage to obtain a driving voltage, wherein the step of raising the analog display voltage comprises:

determining whether the digital image data is within a predetermined range of values, wherein the step of determining whether the digital image data is within a predetermined range of values comprises evaluating whether a most superior bit of the digital image data is equal to 1; and when the digital image data is within the predetermined range, adding a first compensation voltage to the analog display voltage.

2. The method according to claim 1, wherein the selected reference voltage is an adjusted voltage obtained by lowering a reference voltage outputted by a gamma voltage generator.

3. The method according to claim 1, wherein the step of raising the analog display voltage further comprises:

adding a second compensation voltage to the analog display voltage when the digital image data is not within the predetermined range.

4. A method of driving a liquid crystal display panel, comprising:

providing a plurality of reference voltages from a gamma voltage generator;

lowering the provided reference voltages to obtain a plurality of adjusted reference voltages, wherein each of the adjusted reference voltages is derived either as the result of a division operation that divides one reference voltage by a predetermined factor, or as the result of a subtraction operation that subtracts a predetermined voltage from one reference voltage;

according to a content of a digital image data, selecting one of the adjusted reference voltages to convert the digital image data into an analog display voltage; and raising the analog display voltage, including:

multiplying the analog display voltage by the predetermined factor when the adjusted reference voltage that is selected is the result of the division operation, and adding the predetermined voltage to the analog display voltage when the adjusted reference voltage that is selected is the result of the subtraction operation.

5. The method according to claim 4, wherein the step of lowering the provided reference voltages comprises subtracting a same voltage from each of the provided reference voltages.

6. The method according to claim 4, wherein the provided reference voltages include a plurality of first reference voltages and a plurality of second reference voltages, the step of lowering the provided reference voltages comprising:

subtracting a first voltage from each of the first reference voltages; and subtracting a second voltage from each of the second reference voltages, wherein the second voltage is different from the first voltage.

7. The method according to claim 6, wherein the first reference voltages are associated with digital image data having a most superior bit equal to 0, and the second reference voltages are associated with digital image data having a most superior bit equal to 1.

8. The method according to claim 4, wherein the step of lowering the provided reference voltages comprises dividing each of the provided reference voltages by a same factor.

9. The method according to claim 4, wherein the provided reference voltages include a plurality of first reference voltages and a plurality of second reference voltages, the step of lowering the provided reference voltages comprising:

dividing each of the first reference voltages by a first factor; and dividing each of the second reference voltages by a second factor, wherein the second factor is different from the first factor.

10. A driver unit for a display panel, comprising:

a latch circuit for holding digital image data in a voltage state;

a digital-to-analog converter configured to access the voltage state held in the latch circuit for reading a content of the digital image data, and convert the digital image data into an analog display voltage by referring to a reference voltage selected according to the content of the digital image data, wherein the reference voltage that is selected is an adjusted voltage derived either as the result of a subtraction operation that subtracts a predetermined voltage from an initial reference voltage outputted by a gamma voltage generator, or as the result of a division operation that divides the initial reference voltage by a predetermined factor; and a voltage compensator circuit for raising the analog display voltage, wherein the voltage compensator circuit is configured to:

add the predetermined voltage to the analog display voltage when the adjusted voltage is the result of the subtraction operation; and multiply the analog display voltage by the predetermined factor when the adjusted voltage is the result of the division operation.

11. The driver unit according to claim 10, wherein the adjusted reference voltage is the result of the subtraction operation, and the voltage compensator circuit is further configured to:

determine whether the digital image data is within a predetermined range of values; and add a first compensation voltage to the analog display voltage when the digital image data is within the predetermined range.

12. The driver unit according to claim 11, wherein the voltage compensator circuit is configured to determine whether the digital image data is within a predetermined range of values by evaluating whether a most superior bit of the digital image data is equal to 1.

13. The driver unit according to claim 11, wherein the voltage compensator circuit is further configured to add a second compensation voltage to the analog display voltage when the digital image data is not within the predetermined range.

14. The driver unit according to claim 10, wherein the adjusted reference voltage is the result of the division operation, and the voltage compensator circuit is further configured to:

determine whether the digital image data is within a predetermined range of values; and multiply the analog display voltage by a first compensation factor when the digital image data is within the predetermined range.

15. The driver unit according to claim 14, wherein the voltage compensator circuit is further configured to:

multiply the analog display voltage by a second compensation factor when the digital image data is not within the predetermined range.

16. The method according to claim 9, wherein the first reference voltages are associated with digital image data having a most superior bit equal to 0, and the second reference voltages are associated with digital image data having a most superior bit equal to 1.

17. The driver unit according to claim 14, wherein the voltage compensator circuit is configured to determine whether the digital image data is within the predetermined range of values by evaluating whether a most superior bit of the digital image data is equal to 1.

* * * * *